United States Patent [19]

Terbrugge et al.

[11] Patent Number: 5,018,504

[45] Date of Patent: May 28, 1991

[54] METHOD AND APPARATUS FOR CLEANING USED BRICKS

[76] Inventors: Neville C. Terbrugge; Gary Terbrugge; Raymond W. Sifly, all of P.O. Box 1864, Orangeburg, S.C. 29116

[21] Appl. No.: 411,490

[22] PCT Filed: Aug. 31, 1989

[86] PCT No.: PCT/US89/03775

§ 371 Date: Aug. 31, 1989

§ 102(e) Date: Aug. 31, 1989

[51] Int. Cl.[5] ..... B28D 1/20

[52] U.S. Cl. ..... 125/26; 51/206 R

[58] Field of Search ..... 125/26; 51/206 R

[56] References Cited

U.S. PATENT DOCUMENTS

| | | | |
|---|---|---|---|
| 1,239,480 | 9/1917 | Hardin | 125/26 |
| 3,087,483 | 4/1963 | Layelle et al. | 125/26 |
| 4,557,246 | 12/1985 | Seeley | 125/26 |

*Primary Examiner*—Maukina Rachuba

[57] ABSTRACT

A machine for cleaning mortar from used bricks and the like comprising a hopper for moving bricks onto a feeding position at one end of a channel, a ram for pushing one brick after another, each brick pushing a series of preceding bricks, from the feeding position along the channel and through gangs of interleaved spur gear assemblies which crumble the brick mortar and then through scrapers which remove the crumbled mortar from the bricks. The spur gear assemblies are biased to accommodate different sizes of bricks and the hopper moves the bricks into feeding position one at a time.

24 Claims, 5 Drawing Sheets

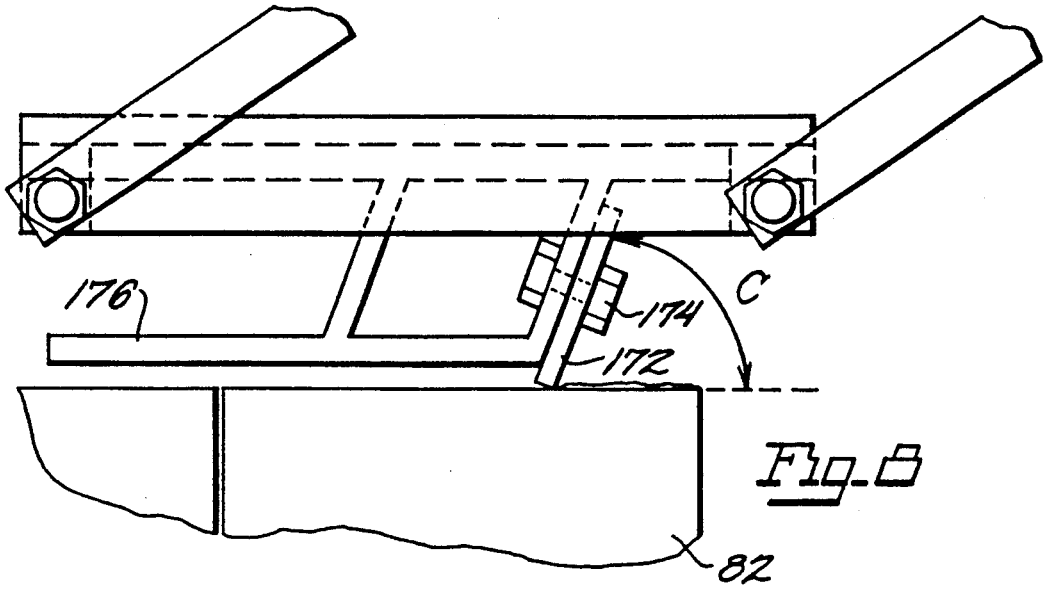
Fig. 8
Fig. 9
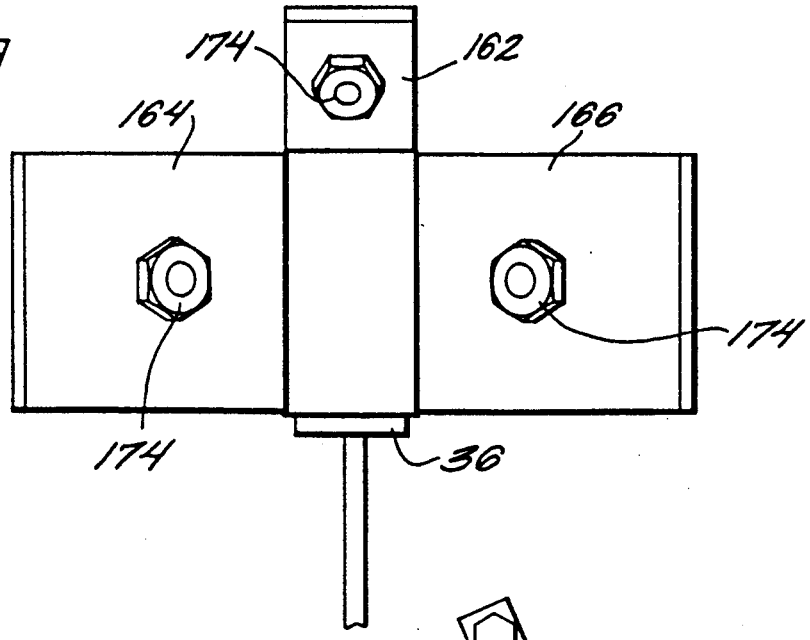
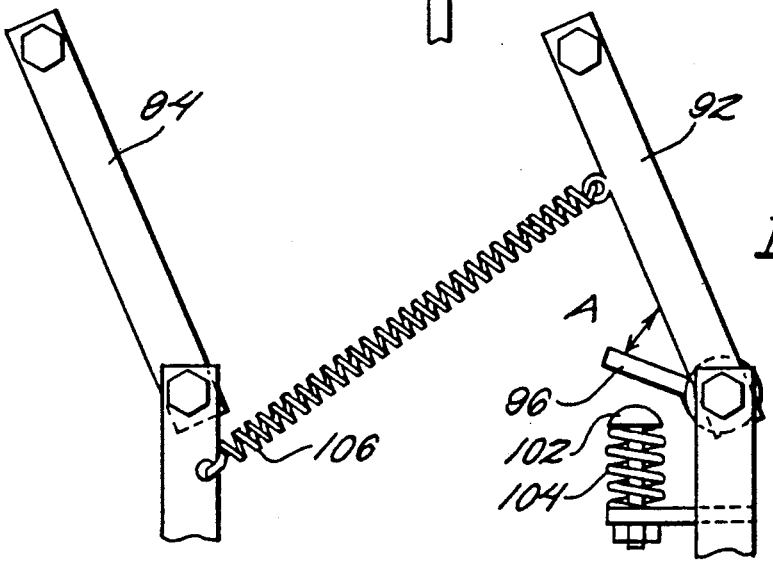
Fig. 10

METHOD AND APPARATUS FOR CLEANING USED BRICKS

BACKGROUND OF THE INVENTION

1. Field of the Invention

The present invention relates to cleaning mortar from used bricks and the like.

2. Discussion of Background

Used bricks and the like from demolished buildings can be reused if the mortar is removed from them. Used bricks are esthetically desirable in newly-built homes designed in a traditional style or in reconstruction of older homes. Buyers of used, cleaned bricks pay up to five times the price of new bricks. Alternatively, the cost of disposing of used bricks can be substantial, thus further encouraging cleaning and reuse.

Brick cleaning is generally done by hand and is hard work. An experienced brick cleaner can clean about one brick per minute but with significant breakage. Furthermore, hand cleaned bricks are not uniform and are harder to work with in construction. There are machines for cleaning bricks, such as those described in U.S. Pat. No. 4,557,246 to Seeley and U.S. Pat. No. Re. 26,868 of La Belle, et al. The Seeley machine has a conveyor belt with spaced dogs for moving individual bricks between spaced, toothed sprockets. The LaVelle et al. machine has toothed rolls that turn in one direction and abrasive rolls that turn in an opposing direction to clean bricks that move along on a conveyor belt.

These machines have a great many moving parts which can become jammed with bricks and crumbled mortar pieces. Both rely on an operator to feed individual bricks onto a conveyer. These machines do not easily accommodate bricks of varying sizes or hand made bricks. These problems and others, and the need for efficient brick cleaning machines, require or consider desirable a used brick cleaning machine that is simple and rugged, accommodates bricks of varying sizes, even at the same time, that thoroughly cleans the mortar from the bricks and can receive a stack of bricks at a one time.

SUMMARY OF THE INVENTION

In accordance with its major aspects, the brick cleaning machine of the present invention comprises a channel on a frame, a hopper at one end of the channel for loading a stack of bricks, a means for moving one brick at a time from the hopper into a feeding position at that end of the channel, a hydraulic ram for advancing the next brick from the feeding position through a mortar crumbling section comprising gangs of interleaved spur gear assemblies. "Interleaved" means the spur gears of a spool are spaced apart so that the spur gears of one spool can be inserted or introduced at regular intervals between the spur gears of an adjacent spool, as shown in FIG. 4. As a brick is advanced by the ram along the channel, it advances a preceding brick and any other bricks in the series through the mortar crumbling section. The spur gear assemblies adjacent the channel crumble the mortar on three sides of the brick, then the series of bricks advance among scrapers which scrape the crumbled mortar from the bricks before each brick exits the opposite end of the channel. Each gang of spur gear assemblies is separately spring biased against the bricks in the channel so that different sizes of bricks can be accommodated.

It is a feature of the present invention that the spur gears are interleaved so that multidirectional forces are applied to break the mortar with the advantage of better crumbling of the mortar than would be achieved by simple penetration of mortar by spurs or teeth.

It is another feature of the present invention that a stack of bricks can be loaded into the hopper and each brick is moved automatically into feeding position, with the advantages that the operator's hands are kept away from the ram and the machine can be more productive because the operator has time to select bricks for cleaning as the machine feeds the bricks from the hopper.

Another feature of the present invention is that there is no conveyor belt; the bricks slide along the flat channel, pushed by an hydraulic ram and subsequent bricks, with the advantage that there is no conveyor to be fouled, and force is directly applied, the axis of the ram aligned with the axis of the series of bricks.

Yet another feature of the present invention is that the scrapers are easily rotated and reversed so that each edge can be used before the scraper is discarded, with the advantage of greater economy.

Still another feature of the present invention is a means for convenient replacement of the gangs of spur gear assemblies. Since the gang closest to the feeding end of the channel will see the greatest wear, it can be replaced and the next gang moved to the forward position with the advantage of greater economy.

These and other features and advantages of the present invention will be apparent to someone skilled in the art of brick cleaning machines from the following figures and description.

FIGS. *7a*, *7b*, *7c* and *7d* are a sequence of detailed side elevations of the brick feeding mechanism with the ram nearing its forewardmost position, returning, in rearmost position, and moving forward, respectively.

FIG. 8 is a detailed side view of the scrapers according to the present invention.

Figure 1:
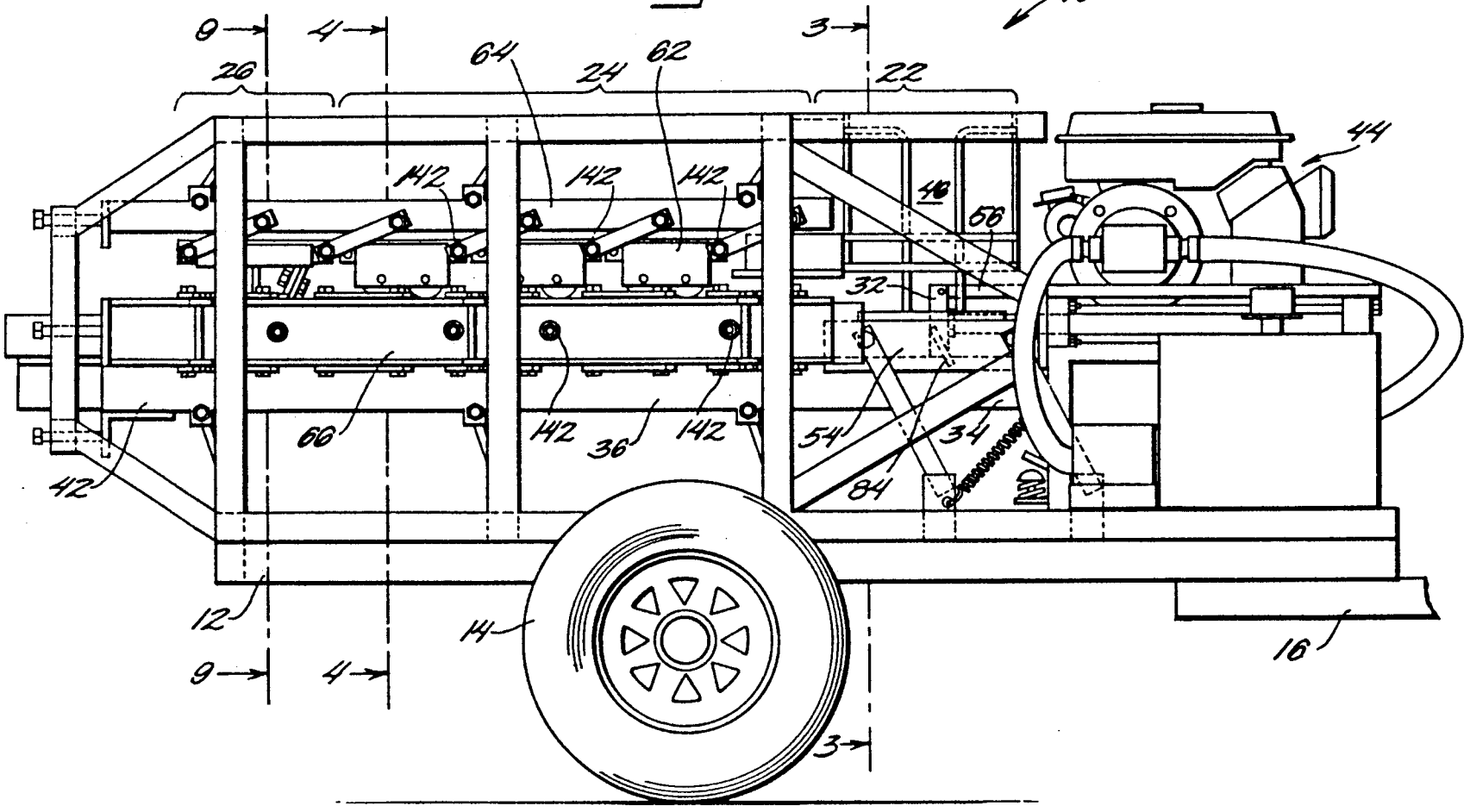
FIG. 1 is a side elevation of an embodiment of the present invention.

FIG. 9 is a detailed end view of the scrapers along line 9—9 of FIG. 1 according to the present invention.

FIG. 10 is a detailed side view brick feeding mechanism limiting springs.

DETAILED DESCRIPTION OF A PREFERRED EMBODIMENT

Figure 2:
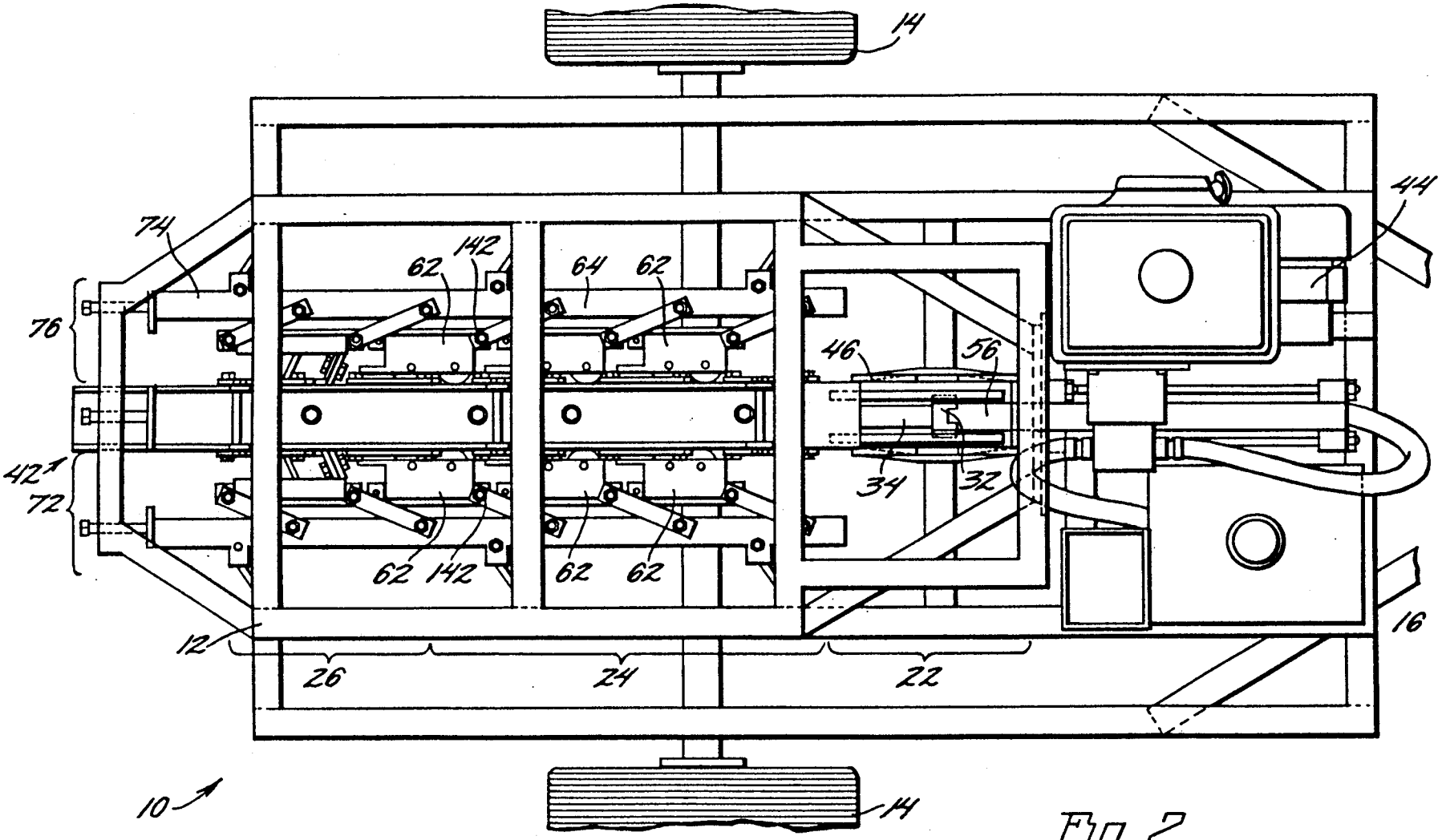
FIG. 2 is a top view of an embodiment of the present invention.

The present invention, indicated in FIGS. 1 and 2 generally by the numeral 10 is an apparatus for cleaning mortar from used bricks and the like. Apparatus 10 is shown mounted on a frame 12 having a pair of wheels 14 and a trailer hitch 16 (shown in part) so that apparatus 10 can be drawn by a light duty vehicle such as a pickup truck. Alternatively, apparatus 10 can be mounted on a flatbed truck or simply moved by a forklift and placed on a pallet or other support.

Apparatus 10 has a feed section 22, a mortar crumbling section 24, and a scraping section 26. Bricks are placed into feeding section 22 and move through mortar crumbling section 24, then the crumbled mortar is scraped therefrom in scraping section 26.

Bricks are advanced through apparatus 10 by a ram 32 that pushes each brick in series at the first end 34 of a channel 36 from feeding section 22 into mortar crumbling section 24, each brick pushing the preceding brick until exiting machine 10 at a second end 42 of channel 36. Ram 32 moves back and forth in a cycle, pushing a brick into mortar crumbling section 24 on the forward stroke and allowing the next brick to be moved into feeding position in the back stroke.

Ram 32 is preferably powered hydraulically using a small gasoline or diesel engine 44. Alternatively, if apparatus is truck mounted, power could be provided by the engine of the truck.

Feeding section 22 has a hopper 46 and a feeding position 52. A stack of bricks is placed in hopper 46 and moved into feeding position 52 by a buggy 54 that cooperates with ram 32. Ram 32 has a plate 56 on which the next brick rests when ram 32 is in a more forward position. As ram 32 moves back, it pulls buggy 54 under the next brick so that the next brick moves onto buggy 54. As ram 32 moves forward, buggy 54 is pushed downward and out of the way of ram 32 as it pushes next brick off buggy 54 and into mortar crumbling section 24.

As bricks in a series are advanced along channel 36 from first end 34 to second end 42, the bricks pass between gangs 62 of interleaved spur gear assemblies. At least one gang 62 is attached, as described more completely below, to a rack 64. There is a top rack 64 above and a right rack 66 on the right side 72 of channel 36. In FIG. 1 racks 64 and 66 are shown; in FIG. 2 racks 64 and 66 are shown as well as left rack 74 on the left side of apparatus 10. Gangs 62 attached to left, right and top racks crumble mortar on three sides of bricks. The fourth side is the "face" of the brick; that is, the face is the side of the brick one sees when looking at a wall of bricks, the side that has no mortar thereon. Thus the bricks move face down along channel 36.

Gangs 62 are attached to racks 65, 66 and 74 in such a way that gangs 62 are biased against the bricks in channel 36 by springs (not shown) between gangs 62 and the rack to which each is mounted. Each gang 62 is unconnected to the next gang, each gang 62 "floating" so that different sized bricks can move through mortar crumbling section 24.

Figure 3:
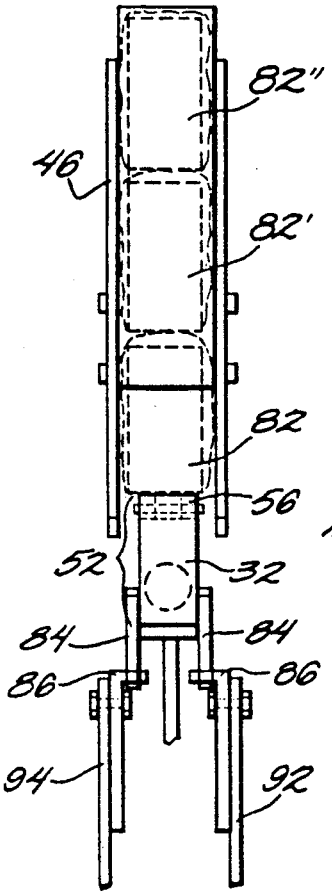
FIG. 3 is a partial cross sectional view along line 3—3 of FIG. 1 showing the hopper according to the present invention.

As seen in FIG. 3, a cross sectional detailed view of feeding section 22 showing a hopper 46 and feeding position 52 with three bricks 82, 82' and 82" indicated in hopper 46. Ram 32 with plate 56 holding next brick 82 is positioned above first end 34 of channel 36. Buggy 54 interacts with ram 32 to catch next brick 82 as ram 32 moves back. Ram 32 has two lateral inclines 84 about which flanges 86 of buggy 54 moves as ram 32 goes through its cycle.

Referring to FIGS. *7a*, *7b*, *7c*, and *7d*, which show the cycle of ram 32 and its interaction with buggy 54, ram 32 is in the nearly forewardmost position in FIG. *7a*. Next brick 82 rests on plate 56 and inclines 84 are riding on flanges 86 of buggy 54 to push it out of the way. At the forewardmost position of ram 32, inclines 84 slip under flanges 86 pulling it up to catch next brick 82 as ram 32 moves rearwardly. At the rearmost portion of motion inclines 84 slip over flanges 84 to push buggy 54 downward. The extremes of motion of buggy 54 are limited by springs, as indicated in FIG. 10. As pivot members 92 and 94 move forward, impact member 96 attached to pivot member 92 at angle A contacts bolt 102 which is biased by spring 104 to resist with increasing force downward movement of impact member 96 and thus limit forward movement of buggy 54. In the reverse direction, spring 106 limits the rearward motion of pivot member 92.

It is also possible to feed bricks from the side by repositioning hopper 46 to the side of apparatus 10 and making adjustments to buggy 54 so that it operates from the side opposite the repositioned hopper.

Figure 6:
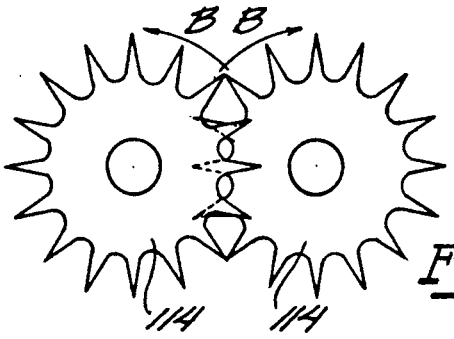
FIG. 6 shows two interleaved spur gear assemblies according the present invention.
Figure 4:
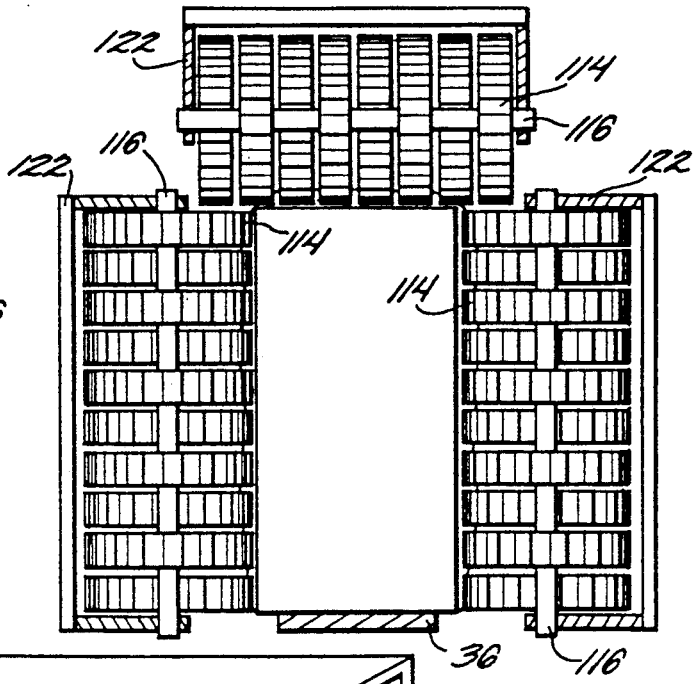
FIG. 4 is a partial cross sectional view along line 4—4 of FIG. 1 showing the spur gear assemblies according to the present invention.
Figure 5:
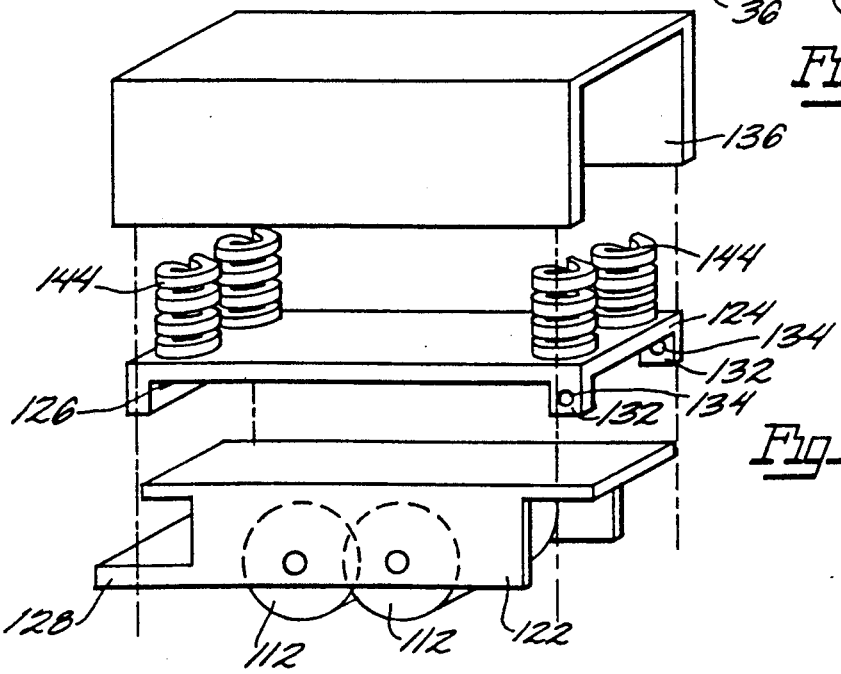
FIG. 5 is an exploded, perspective view of a gang of spur gear assemblies according to the present invention.
Figure 7B:
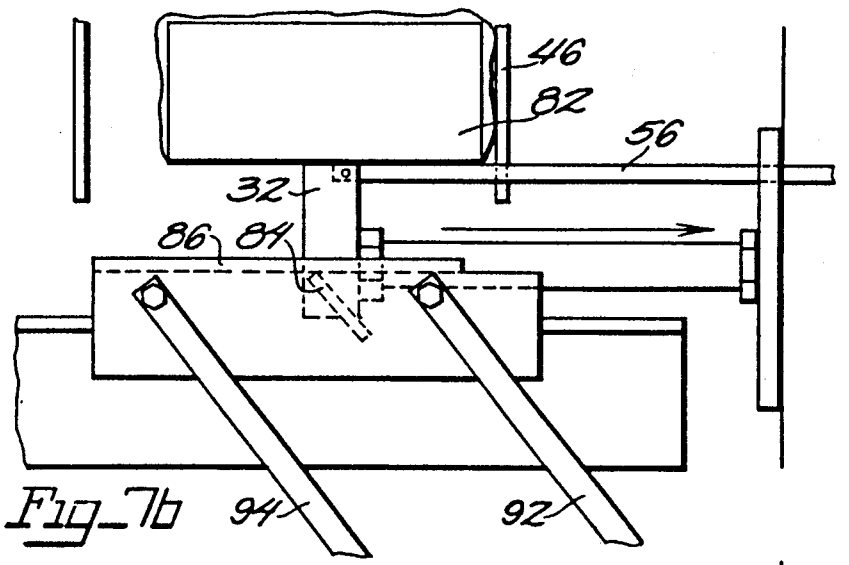
Figure 7D:
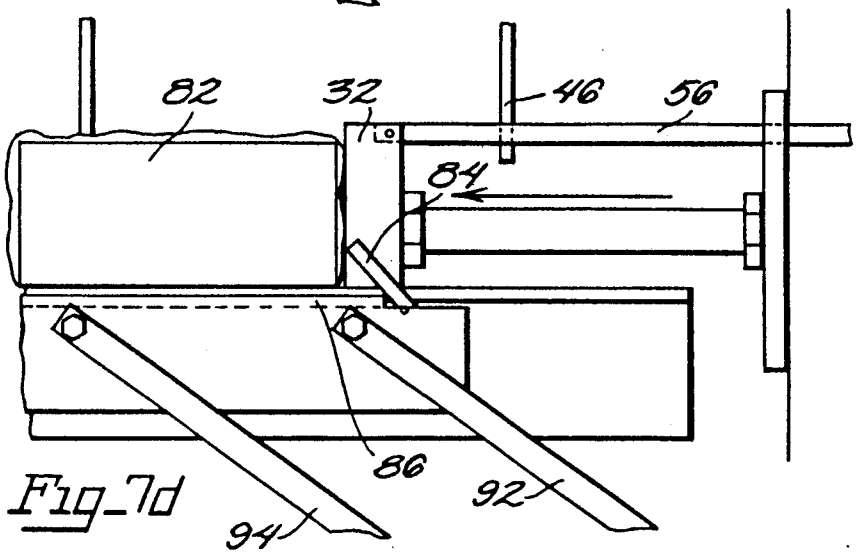
Figure 7A:
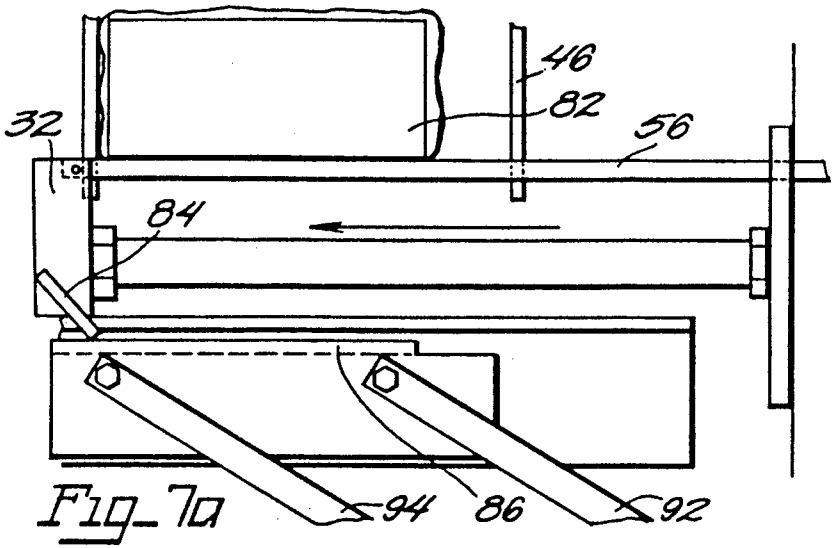
Figure 7C:
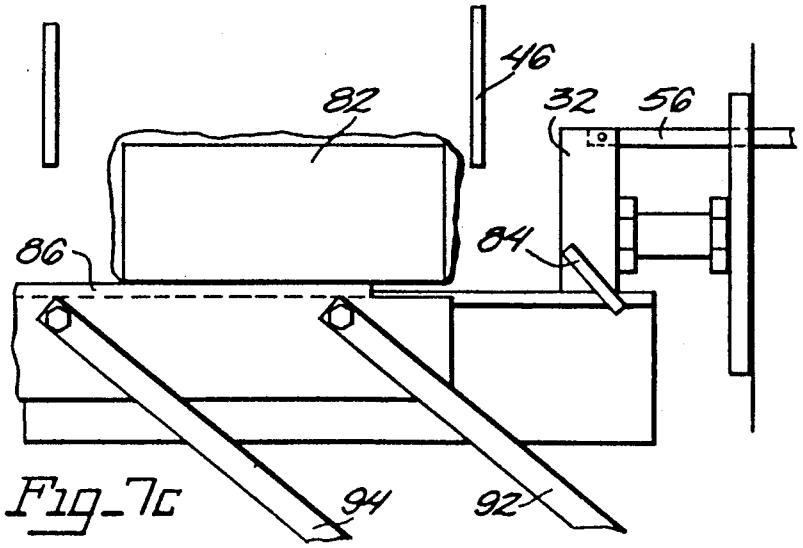

In mortar crumbling section 24, gangs 62 comprise interleaved spur gear assemblies 112, each assembly having two spur gears 114 attached to a spool 116 in spaced relation so that the spur gears of an assembly interleave with the spur gears of an adjacent assembly, as shown in FIGS. 4 and 6. Spools 116 are seated in a carrier 122 which slips into a holder 124 having a slot 126 at one end with extension 128 to keep bricks in line and flanges 132 with holes 134 for a bolt at the other end. Holders 124 are attached to racks 64, 66, or 74; a portion of a rack 136 is shown in FIG. 5. A bolt 142 (not shown in FIG. 5 but shown in FIGS. 1 and 2) holds gang 54 to rack 136 but gang 54 is biased by springs 144 so that holder 124 can "float" to accommodate varying sizes of bricks on channel 36. Preferably about 5 centimeters of float are sufficient. Members 146 attach between rack 135 and holder 124 to help hold gangs 62 in position by resisting longitudinal stresses.

Spur gears 114, turning freely, will penetrate mortar on bricks in channel 36. Furthermore, interleaves spur gears, turning in the same direction, as indicated by the letter B in FIG. 6, will produce opposing forces on the mortar of bricks in channel 36. These opposing forces are believed to cause more complete and quicker crumbling of mortar. As the spur gear assemblies 112 of one gang 62 wear down, that gang 62 can be replaced or rotated with another gang for greater economy. A gang can be replaced by unfastening bolt 142 and sliding carrier 122 out of slot 126 in holder 124.

Gangs 62 may be larger for the sides of channel 36 than the top because bricks are generally narrower in width than height. Therefore, five spur gears per assembly is preferred for sides of bricks and four are preferred for widths of bricks, which of course depends on the width of the spur gears 114.

To make assemblies 112, spur gears 114 are stamped from a sheet of steel alloy, hardening spur gears 114 to a Rockwell Index between 30 and 40, and then tack welding the appropriate number of hardened spur gears 114 to spool 116 at intervals along said spool so that said spurs to two similar spools interleave without interference when one of said spur gear assemblies is inverted. The assemblies are freely rotating so they do not track in the mortar; that is, subsequent spurs do not penetrate the same places on the mortar a previous spurs.

At the second end 42 of channel 36 are three scrapers: a top scraper 162, a left scraper 164 and a right scraper 166 (See FIGS. 1, 2 and 9). Shown in detail in FIGS. 8 and 9, each scraper 172 is a thick square, preferably made of tool grade steel, having a side dimension equal to the side of the brick it is to scrape. Each scraper 172 is mounted to meet the oncoming series of bricks at an angles C less than 90 degrees. Each scraper 172 is attached by a single bolt 174 through the center of scraper 172 so that, as the side of scraper 172 that meets the brick becomes worn, the scraper bolt 174 can be loosened and scraper 172 rotated 90 degrees to expose a new edge to the series of bricks. If all four edges of scraper 172 become worn, scraper 172 can be reversed to provide four more edges. Scrapers are mounted to the corresponding rack 64, 66 or 74 by a bracket 176.

Channel 36 need be only wide enough to allow support for bricks in a series; it should allow room for crumbled mortar to exit by gravity from mortar crumbling section 24, as indicated in FIG. 9.

The presently preferred embodiment of the present invention has been shown and described with a degree of particularity, but it should be understood that the scope of the invention is defined in the following claims.

What is claimed is:

1. A machine for removing mortar from used bricks and the like comprising:

a frame;

a channel attached to said frame, said channel having a first end and a second end;

a means for pushing bricks onto said first end of said channel, said pushing means in spaced relation to said first end of said channel, each brick pushing a preceding brick along said channel toward said second end;

means for crumbling mortar on bricks moving on said channel, said crumbling means adjacent said channel and in contact with bricks on said channel, said crumbling means further comprises gangs of interleaved spur gear assemblies in spaced relation to said channel so that said spur gear assemblies press against said bricks to penetrate and crumble said mortar on said bricks as said bricks move on said channel from said first end to said second end; and means for scraping crumbled mortar from said bricks as said bricks approach said second end of said channel.

2. The machine is claim 1 wherein at least one of said gangs of spur gears is biased against a side of said bricks moving on said channel so that as bricks having at least one larger dimension enter said first end of said channel, said biased spur gear gang accommodate said larger bricks.

3. The machine of claim 1 further comprising:

a hopper dimensioned for storing a stack of bricks in spaced relation to said channel; and a means for moving said bricks from said hopper to said first end of said channel.

4. The machine of claim 2 further comprising:

a hopper dimensioned for storing a stack of bricks in spaced relation to said channel; and a means for moving said bricks from said hopper to said first end of said channel.

5. The machine of claim 1 wherein said pushing means is a hydraulic ram.

6. The machine of claim 2 wherein said pushing means is a hydraulic ram.

7. The machine of claim 3 wherein said pushing means is a hydraulic ram.

8. The machine of claim 1 wherein said spur gear assemblies are made by a process comprising the steps of:

stamping a plurality of spur gears from a sheet of steel alloy;

hardening said plurality of spur gears to a Rockwell Index between 30 and 40; and tack welding a number of said hardened spur gears to a spool at intervals along said spool so that said spurs of two similar spools interleave without interference when one of said spur gear assemblies is inverted.

9. The machine of claim 2 wherein said spur gear assemblies are made by a process comprising the steps of:

stamping a plurality of spur gears from a sheet of steel alloy;

hardening said plurality of spur gears to a Rockwell Index between 30 and 40; and tack welding a number of said hardened spur gears to a spool at intervals along said spool so that said spurs of two similar spools interleave without interference when one of said spur gear assemblies is inverted.

10. The machine of claim 4 wherein said spur gear assemblies are made by a process comprising the steps of:

stamping a plurality of spur gears from a sheet of steel alloy;

hardening said plurality of spur gears to a Rockwell Index between 30 and 40; and tack welding a number of said hardened spur gears to a spool at intervals along said spool so that said spurs of two similar spools interleave without interference when one of said spur gear assemblies is inverted.

11. The machine of claim 1 wherein said scraping means comprises a rectangular plate on each of three sides of said channel at said second end, said plate positioned at an angle less than ninety degrees with respect to the long axis of said channel, said plate set in close proximity to the sides of said bricks as said bricks pass from said crumbling means so that crumbled mortar can be scraped from the sides of said bricks, and said plate dimensioned so that each plate can be periodically turned to present a new edge to said bricks.

12. The machine of claim 2 wherein said scraping means comprises a rectangular plate on each of three sides of said channel at said second end, said plate positioned at an angle less than ninety degrees with respect to the long axis of said channel, said plate set in close proximity to the sides of said bricks as said bricks pass from said crumbling means so that crumbled mortar can be scraped from the sides of said bricks, and said plate dimensioned so that each plate can be periodically turned to present a new edge to said bricks.

13. The machine of claim 3 wherein said scraping means comprises a rectangular plate on each of three sides of said channel at said second end, said plate positioned at an angle less than ninety degrees with respect to the long axis of said channel, said plate set in close proximity to the sides of said bricks as said bricks pass from said crumbling means so that crumbled mortar can be scraped from the sides of said bricks, and said plate dimensioned so that each plate can be periodically turned to present a new edge to said bricks.

14. The machine of claim 5 wherein said scraping means comprises a rectangular plate on each of three sides of said channel at said second end, said plates positioned at an angle less than ninety degrees with respect to the long axis of said channel, said plate set in close proximity to the sides of said bricks as said bricks pass from said crumbling means so that crumbled mortar can be scraped from the sides of said bricks, and said plate dimensioned so that each plate can be periodically turned to present a new edge to said bricks.

15. A machine for removing mortar from used bricks and the like comprising:

a frame having a channel, said channel having a first end and a second end;

a means for feeding bricks onto said first end of said channel, said feeding means in operative connection with said channel;

gangs of interleaved spur gear assemblies on three adjacent sides of bricks on said channel; and means for scraping crumbled mortar from said bricks as said bricks approach said second end of said channel.

16. The machine of claim 15 wherein said feeding means further comprises:

a hopper dimensioned to receive a stack of bricks;

a means for placing without dropping a brick into said feed position at said first end of said channel, said placing means in operative connection with said hopper; and a ram for pushing said brick forward from said feed position into said channel.

17. The machine of claim 15 wherein at least two of said at least one gang of interleaved spur gear assemblies are biased against adjacent sides of bricks in said channel.

18. The machine of claim 16 wherein at least two of said at least one gang of interleaved spur gear assemblies are biased against adjacent sides of bricks in said channel.

19. The machine of claim 15 wherein said at least one gang of interleaves spur gear assemblies further comprises:

a yoke;

a plurality of parallel spools rotatably mounted to said yoke; and a plurality of spur gears attached to each of said spools, said spools positioned so that spur gears of one spool interleave with spur gears of an adjacent spool.

20. The machine of claim 16 wherein said at least one gang of interleaved spur gear assemblies further comprises:

a yoke;

a plurality of parallel spools rotatably mounted to said yoke; and a plurality of spur gears attached to each of said spools, said spools positioned so that spur gears of one spool interleave with spur gears on an adjacent spool.

21. The machine of claim 17 wherein said at least one gang of interleaved spur gear assemblies further comprises:

a yoke;

a plurality of parallel spools rotatably mounted to said yoke; and a plurality of spur gears attached to each of said spools, said spools positioned so that spur gears of one spool interleave with spur gears of an adjacent spool.

22. The machine of claim 18 wherein said at least one gang of interleaved spur gear assemblies further comprises:

a yoke;

a plurality of parallel spools rotatably mounted to said yoke; and a plurality of spur gears attached to each of said spools, said spools positioned so that spur gears of one spool interleave with spur gears of an adjacent spool.

23. The machine of claim 15 wherein said spur gear gangs are made by a process comprising the steps of:

a stamping a plurality of spur gears from a sheet of steel alloy;

hardening said plurality of spur gears to have a Rockwell Index between 30 and 40; and tack welding a number of said spur gears to said spools at intervals along said spools so that said spurs of two identical spools interleave when one of said spur gears is inverted; and mounting at least two spools to a yoke so that said spools rotate freely.

24. A method for removing mortar from bricks and the like comprising the steps of:

placing a plurality of bricks in a hopper;

moving said plurality of bricks to a feed position;

pushing said plurality of bricks from said feed position onto a channel one brick at a time;

crumbling mortar on the sides of said first brick with gangs of interleaved spur gears; and scraping said crumbled mortar from the sides of said first brick.

* * * * *